US005351962A

United States Patent [19]

Lin

[11] Patent Number: 5,351,962

[45] Date of Patent: Oct. 4, 1994

[54] GOLF PUTTING PRACTICE DEVICE

[76] Inventor: Lung-Chian Lin, 4F., No. 4, Lane 55, Chunghsiao St., Chung-Ho City, Taipei Hsian, Taiwan

[21] Appl. No.: 149,557

[22] Filed: Nov. 9, 1993

[51] Int. Cl.[5] ..... A63B 69/36

[52] U.S. Cl. ..... 273/186.2; 273/187.1

[58] Field of Search ..... 273/186.2, 186.4, 163 R, 273/163 A, 164.1, 164.2

[56] References Cited

U.S. PATENT DOCUMENTS

| | | | |
|---|---|---|---|
| 1,536,512 | 5/1925 | Laren | 273/186.2 |
| 3,021,141 | 2/1962 | Polsky et al. | 273/186.2 X |
| 4,720,110 | 1/1988 | Hurst | 273/186.2 |
| 4,944,517 | 7/1990 | Redkey | 273/186.2 |
| 5,143,376 | 9/1992 | Johnson | 273/186.2 |

*Primary Examiner*—George J. Marlo
*Attorney, Agent, or Firm*—Bacon & Thomas

[57] ABSTRACT

A golf putting practice device permitting inspection of linear perpendicular movement gravitational center of a putting club, composed of a connecting seat, a perpendicular standard strip and a pad member, wherein the pad member is rectangular, formed with a standard line and a circle positioned at a middle portion of the standard line, whereby during the movements of aiming, moving back, moving forward, hitting and moving following the ball, the player is able to inspect whether the standard strip is overlapped on the standard line and correct the linear perpendicular putting movement to place the gravitational center of the putting club on the line connecting the golf ball and the ball hole so as to achieve a correct putting track and attitude.

1 Claim, 5 Drawing Sheets

GOLF PUTTING PRACTICE DEVICE

BACKGROUND OF THE INVENTION

The present invention relates to a golf putting practice device permitting inspection of linear perpendicular movement of gravitational center of a putting club, and more particularly to a golf putting practice device in which during the movements of aiming, moving back, moving forward, hitting and moving following the ball, the player is able to inspect whether the gravitational center of the putting club is on the line connecting the golf ball and the ball hole so as to achieve a correct putting track and attitude.

The currently widely used golf practice device is a lawn skin green practice device composed of a long strip of artificial lawn and a simulative ball hole. A player can repeatedly practice by means of such device, while such device cannot aid in the correction of the putting skill and attitude of the player. Moreover, one reason for failing to have progress in the putting skill is that when putting the golf ball, the ball is not hit steadily. During the movements of aiming, moving back, moving forward, hitting the ball and moving following the ball, the gravitational center of the putting surface, i.e., the sweet spot does not move linear perpendicularly along the line connecting the ball and the ball hole. As shown in FIG. 4, after aiming the ball hole, the player often putts the ball along a deflected track B or C other than the aiming track A.

Also, as shown in FIG. 4, according to the physical movement of human body, the center of the putting movement resides in the hand of the player and the putting track is actually an arch track rather than a linear perpendicular track. Therefore, it is necessary to use a device to correct the putting attitude. Most of the conventional golf practice devices are complex and cannot provide the user with simple and quick inspection measure.

SUMMARY OF THE INVENTION

It is a primary object of the present invention to provide a golf putting practice device permitting inspection of linear perpendicular movement of gravitational center of a putting club. By means of the above device, during the movements of aiming, moving back, moving forward, hitting and moving following the ball, the player is able to inspect whether the gravitational center of the putting club is on the line connecting the golf ball and the ball hole so as to achieve a correct putting track and attitude.

It is a further object of the present invention to provide the above device, wherein a conventional movable green can be used together with the above device indoors or outdoors to simulate the putting movement in an actual green.

It is still a further object of the present invention to provide the above device which is connected with a putting club to aid a player in aiming and placing the gravitational center of the putting surface on the line connecting the ball and ball hole.

The present invention can be best understood through the following description and accompanying drawing, wherein:

DETAILED DESCRIPTION OF THE PREFERRED EMBODIMENT

Figure 1:
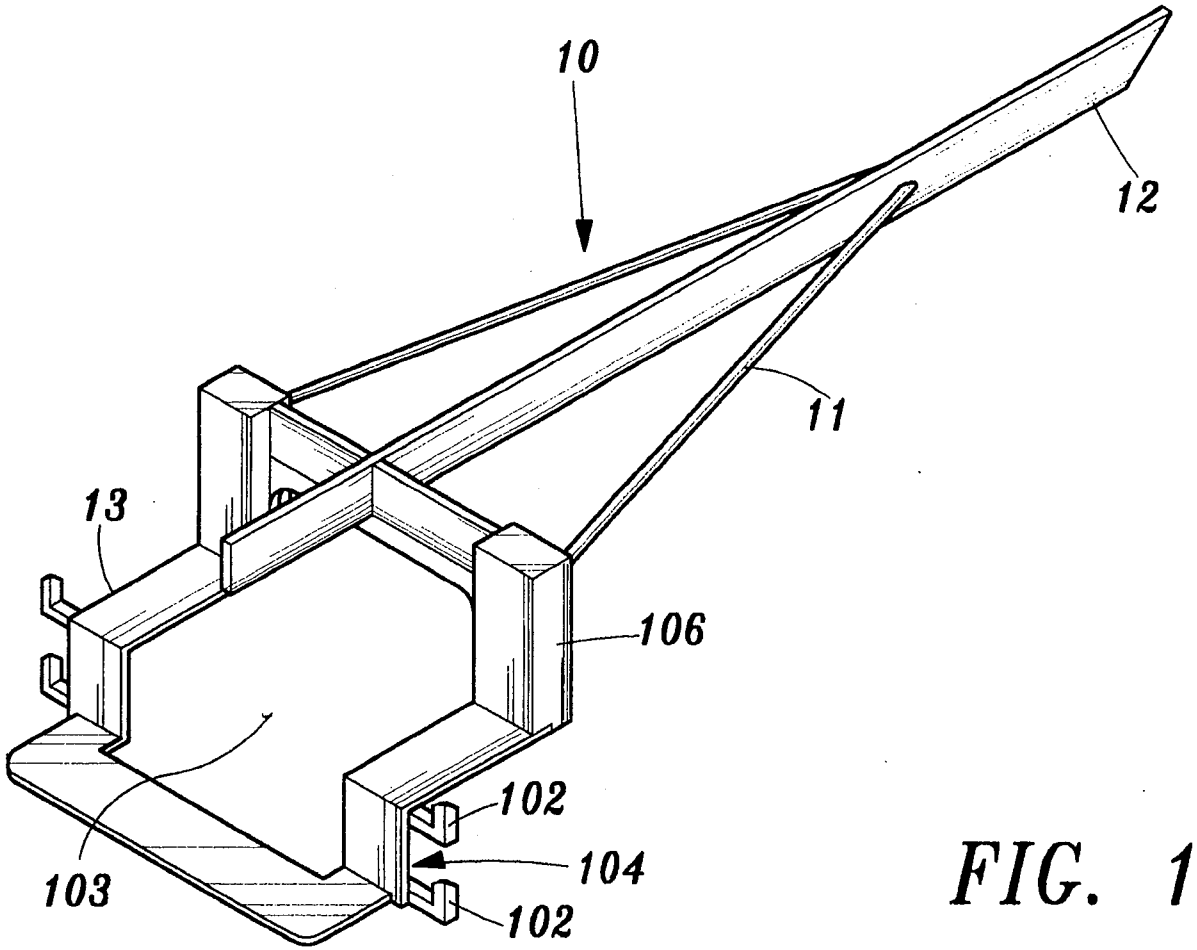
FIG. 1 is a perspective assembled view of the present invention.
Figure 2A:
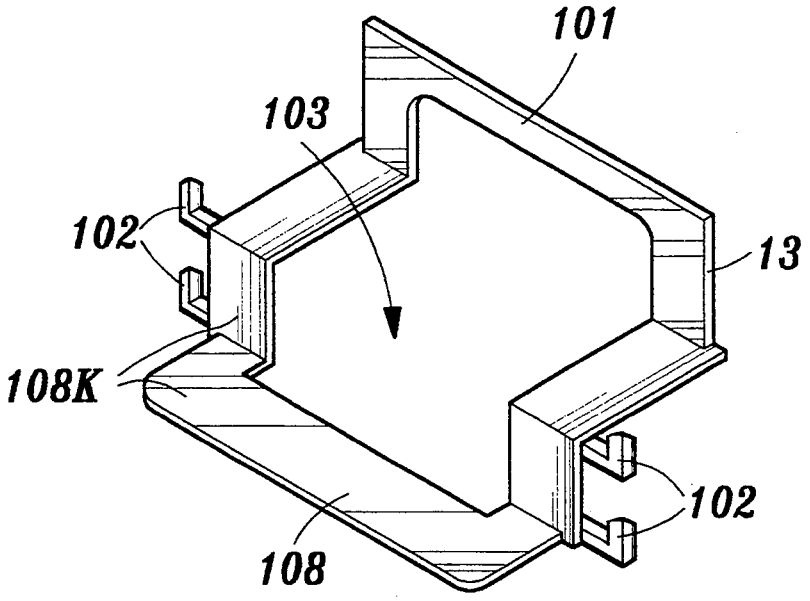
FIG. 2A is a perspective view of the connecting seat thereof.
Figure 3:
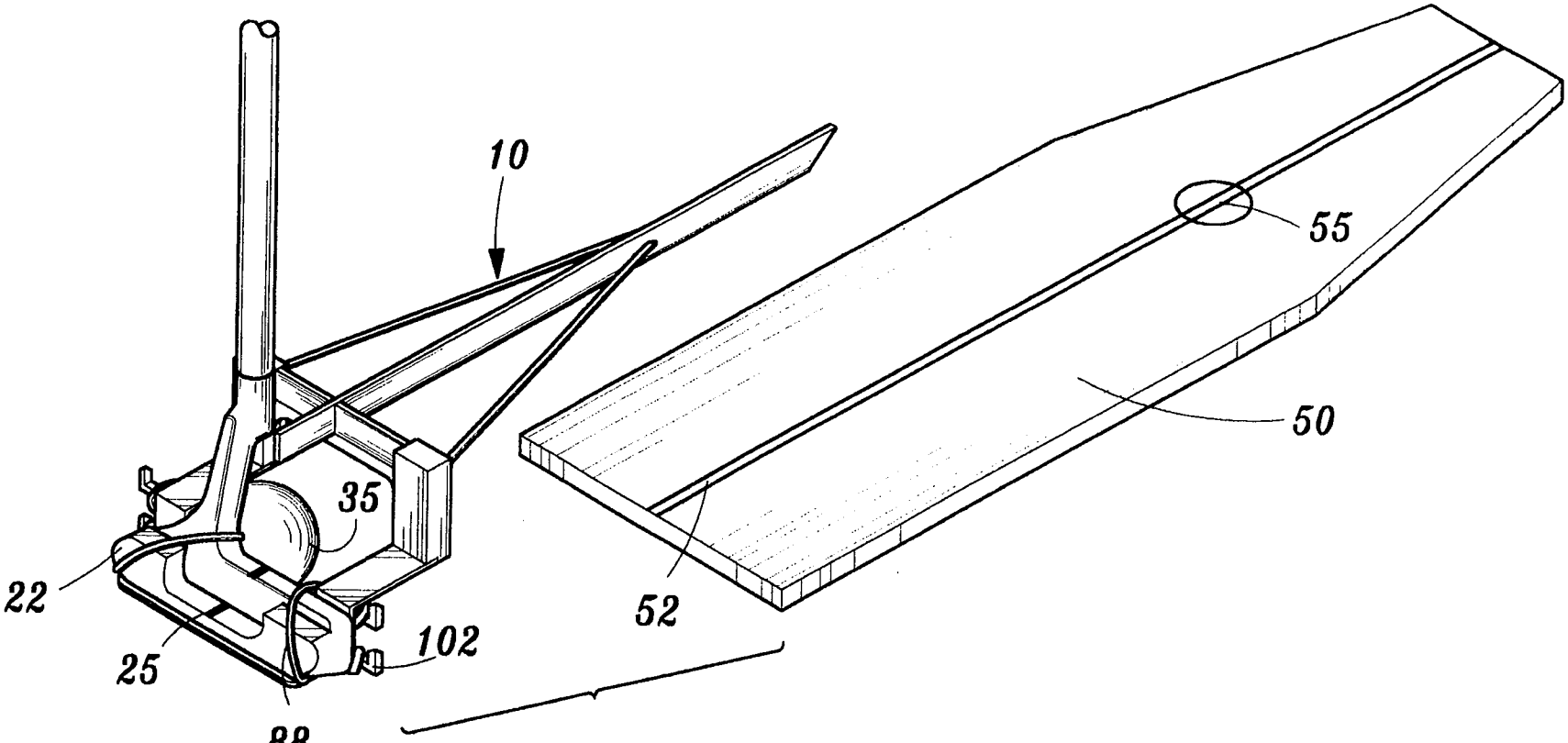
FIG. 3 shows the application of the present invention.

Please refer to FIGS. 1 and 2A. The practice device according to the present invention is composed of a connecting seat 13, a perpendicular standard strip 12 and a pad member 50, wherein the connecting seat 13 is substantially W-shaped, having an upper vertical U-shaped board 101 defining a visually inspecting hole 103 and a lower horizontal support board 108 defining a fixing hole 104. Two pairs of L-shaped hook members are disposed on two sides of the support board 108. The support board 108 has a support surface 108K for fixing a putting club 22 as shown in FIG. 3. The putting club 22 is associated with the connecting seat 13 in such a manner that as shown in FIG. 3, the putting club 22 is placed in the fixing hole 104 on the support surface 108K and tied on the hook members 102 by rubber rings 88. In addition, a double-face adhesive tape can be applied to the support surface 108K for enhancing the association of the putting club with the connecting seat 13.

Figure 2B:
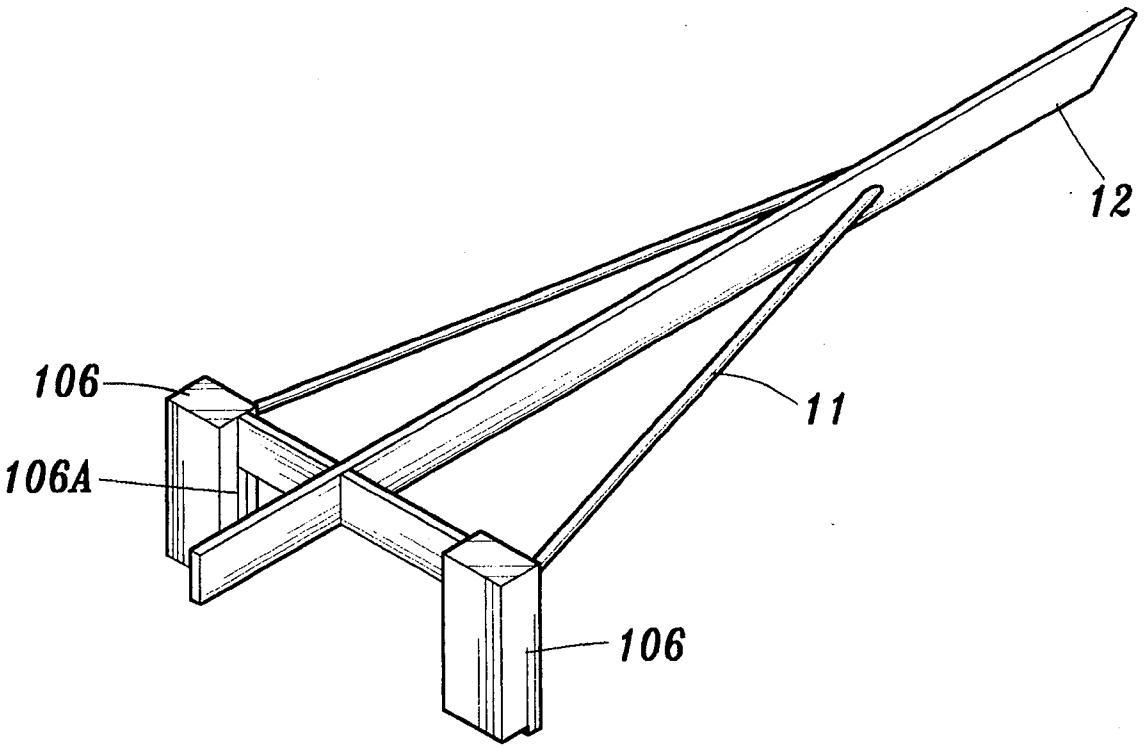
FIG. 2B is a perspective view of the perpendicular standard strip thereof.

Please refer to FIGS. 1 and 2B. The perpendicular standard strip 12 has a left and a right support rods 11 which are respectively connected with two connecting columns 106. Each of the columns 106 is formed with a fissure 106A, whereby as shown in FIG. 1, when the strip 12 is associated with the connecting seat 13, the connecting columns 106 are fitted on the U-shaped board 101 of the connecting seat 13 with the U-shaped board 101 inserted in the fissures 106A.

Figure 4:
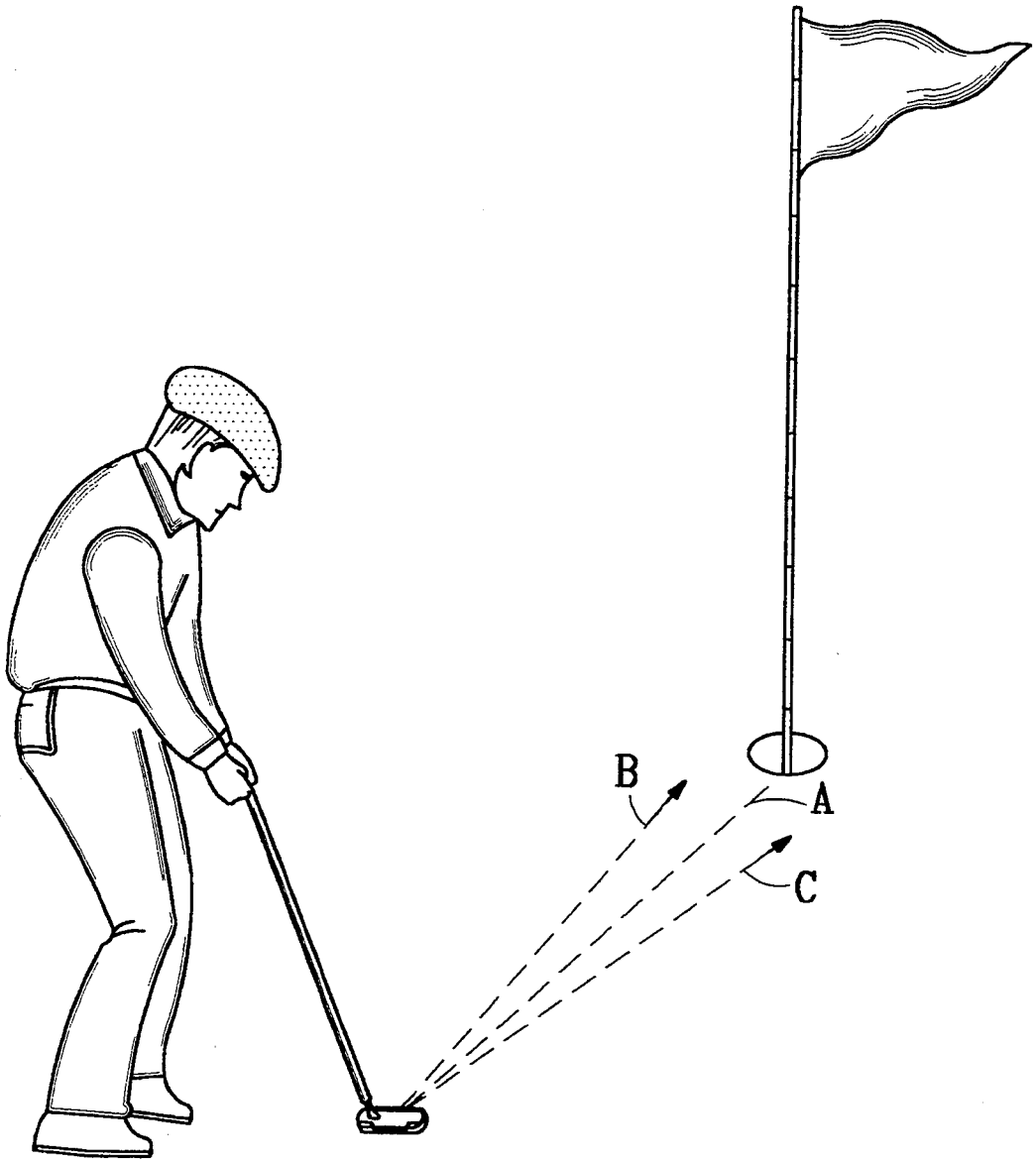
FIG. 4 shows the putting tracks of a player.

Please refer to FIG. 3. After the putting club 22 is connected with the assembly of the connecting seat 13 and the standard strip 12, a golf ball 35 can be placed in the inspecting hole 103 and a player can see the golf ball through the inspecting hole 103 when putting the golf ball 35 as shown in FIG. 4. Referrring to FIG. 3, the pad member 50 is rectangular, formed with a standard line 52 and a circle 55 positioned at a middle portion of the standard line 52. When the player uses the practice device, the standard strip 12 is first aligned with a gravitational center 25 of the putting club 22, i.e., the sweet spot. Then, when aiming the golf ball, the player must and overlap the perpendicular standard strip 12 on the standard line 52 of the pad member 50 as shown in FIG. 3, whereby during the movements of aiming, moving back, moving forward, hitting and moving following the ball, the player can inspect whether the standard strip 12 is overlapped on the standard line 52 and correct the putting movement to place the sweet spot on the line connecting the golf ball and the ball hole. Therefore, the player can achieve a correct putting attitude. Alternatively, the player can use the present invention to practice and inspect the putting movement without hitting the ball.

What is claimed is:

1. A golf putting practice device permitting inspection of linear perpendicular movement of gravitational center of a putting club, composed of a connecting seat, a perpendicular standard strip and a pad member, wherein said connecting seat is substantially W-shaped, having an upper vertical U-shaped board defining a visually inspecting hole and a lower horizontal support board defining a fixing hole, two pairs of L-shaped hook members being disposed on two sides of said support board, said support board having a support surface for fixing a putting club, said perpendicular standard strip having a left and a right support rods which are respectively connected with two connecting columns each of which is formed with a fissure, whereby when said standard strip is associated with said connecting seat, said connecting columns are fitted on said U-shaped board of said connecting seat with said U-shaped board inserted in said fissures, said pad member being rectangular, formed with a standard line and a circle positioned at a middle portion of said standard line.

* * * * *